US009489911B2

(12) United States Patent
Aoki et al.

(10) Patent No.: US 9,489,911 B2
(45) Date of Patent: Nov. 8, 2016

(54) DISPLAY DEVICE

(71) Applicant: Japan Display Inc., Tokyo (JP)

(72) Inventors: Yoshinori Aoki, Tokyo (JP); Yuji Maede, Tokyo (JP); Keita Sasanuma, Tokyo (JP)

(73) Assignee: Japan Display Inc., Tokyo (JP)

( * ) Notice: Subject to any disclaimer, the term of this patent is extended or adjusted under 35 U.S.C. 154(b) by 47 days.

(21) Appl. No.: 14/327,793

(22) Filed: Jul. 10, 2014

(65) Prior Publication Data

US 2015/0015619 A1 Jan. 15, 2015

(30) Foreign Application Priority Data

Jul. 10, 2013 (JP) ..... 2013-144387

(51) Int. Cl.
*G09G 3/36* (2006.01)

(52) U.S. Cl.
CPC ..... *G09G 3/3696* (2013.01); *G09G 3/3685* (2013.01); *G09G 2300/0426* (2013.01); *G09G 2300/0452* (2013.01); *G09G 2370/08* (2013.01)

(58) Field of Classification Search
CPC ..... G09G 3/2074; G09G 3/3614; G09G 3/3696; G09G 3/3685
USPC ..... 345/89, 96
See application file for complete search history.

(56) References Cited

U.S. PATENT DOCUMENTS 7,911,541 B2 3/2011 Yamamoto et al.
2004/0046725 A1* 3/2004 Lee ..... G09G 3/3607 345/88
2005/0275610 A1* 12/2005 Roh ..... G09G 3/3614 345/88
2006/0007723 A1* 1/2006 Aoki ..... G09G 3/3614 365/98
2006/0187386 A1* 8/2006 Roh ..... G02F 1/133555 349/114
2006/0290831 A1* 12/2006 You ..... G09G 3/3696 349/56
2007/0013649 A1* 1/2007 Kim ..... G09G 3/344 345/107
2007/0236422 A1* 10/2007 Park ..... G09G 3/3291 345/76
2008/0024411 A1* 1/2008 Hsieh ..... G09G 3/3648 345/89
2008/0049048 A1* 2/2008 Credelle ..... G09G 3/2074 345/690
2008/0084376 A1* 4/2008 Hirota ..... G09G 3/3648 345/88
2008/0158203 A1* 7/2008 Irie ..... G09G 3/3648 345/87
2010/0039453 A1* 2/2010 Chaji ..... G09G 3/3696 345/690
2012/0044427 A1* 2/2012 Irie ..... G09G 3/3607 345/89
2012/0320297 A1* 12/2012 Itsumi ..... G09G 3/3648 349/43

FOREIGN PATENT DOCUMENTS

JP 2007-10753 A 1/2007

* cited by examiner

*Primary Examiner* — Adam J Snyder
(74) *Attorney, Agent, or Firm* — TYPHA IP LLC

(57) ABSTRACT

A display device includes a first pixel group and a second pixel group. A central value of positive-side and negative-side grayscale voltages of the first pixel group is set to be a fixed value. A common voltage is adjusted to its optimal value with respect to the first pixel group. A difference between the common voltage adjusted to the optimal value with respect to the first pixel group and an optimal common voltage of the second pixel group is corrected by shifting entire positive-side and negative-side grayscale voltages of the second pixel group in a vertical direction.

15 Claims, 13 Drawing Sheets

FIG.9

| | REGISTER (BINARY) | REGISTER (HEX) | V255P | VOP | V255N | VON |
|---|---|---|---|---|---|---|
| 1 | 000000 | 00 | 127R/127R | 127R/127R | 127R/127R | 127R/127R |
| 2 | 000001 | 01 | 125R/127R | 125R/127R | 125R/127R | 125R/127R |
| 3 | 000010 | 02 | 123R/127R | 123R/127R | 123R/127R | 123R/127R |
| 4 | 000011 | 03 | 121R/127R | 121R/127R | 121R/127R | 121R/127R |
| 5 | 000100 | 04 | 119R/127R | 119R/127R | 119R/127R | 119R/127R |
| 6 | 000101 | 05 | 117R/127R | 117R/127R | 117R/127R | 117R/127R |
| ... | ... | ... | ... | ... | ... | ... |
| 59 | 111010 | 3A | 11R/127R | 11R/127R | 11R/127R | 11R/127R |
| 60 | 111011 | 3B | 9R/127R | 9R/127R | 9R/127R | 9R/127R |
| 61 | 111100 | 3C | 7R/127R | 7R/127R | 7R/127R | 7R/127R |
| 62 | 111101 | 3D | 5R/127R | 5R/127R | 5R/127R | 5R/127R |
| 63 | 111110 | 3E | 3R/127R | 3R/127R | 3R/127R | 3R/127R |
| 64 | 111111 | 3F | 1R/127R | 1R/127R | 1R/127R | 1R/127R |

FIG.10

| | REGISTER (BINARY) | REGISTER (HEX) | V255P,VOP | V255N,VON |
|---|---|---|---|---|
| 1 | 000000 | 00 | 32R | -32R |
| 2 | 000001 | 01 | 31R | -31R |
| 3 | 000010 | 02 | 30R | -30R |
| ... | ... | ... | ... | ... |
| 30 | 011101 | 1D | 3R | -3R |
| 31 | 011110 | 1E | 2R | -2R |
| 32 | 011111 | 1F | 1R | -1R |
| 33 | 100000 | 20 | 0R | 0R |
| 34 | 100001 | 21 | -1R | 1R |
| 35 | 100010 | 22 | -2R | 2R |
| 36 | 100011 | 23 | -3R | 3R |
| ... | ... | ... | ... | ... |
| 62 | 111101 | 3D | -29R | 29R |
| 63 | 111110 | 3E | -30R | 30R |
| 64 | 111111 | 3F | -31R | 31R |

DISPLAY DEVICE

CLAIM OF PRIORITY

The present application claims priority from Japanese patent application JP2013-144387 filed on Jul. 10, 2013, the content of which is hereby incorporated by reference into this application.

BACKGROUND

The present invention relates to a display device, and is applicable to a display device of an RGBW scheme, for example.

The luminance of white display in a liquid-crystal display (LCD) is determined by the luminance of a backlight and the transmittance of liquid crystals. Enhancing the luminance of the backlight leads to an increase in electric power consumption. It is preferable the transmittance of the liquid crystals be enhanced. As described in JP-2007-010753-A or in U.S. Pat. No. 7,911,541 corresponding thereto, there is an example of a display device which realizes white peak display by raising the transmittance of liquid crystals substantively and thus enhancing the luminance of white. This existing method is intended to achieve the enhancement of transmittance without an increase in electric power consumption by use of pixels of white (W) in addition to those of the primary colors, red (R), green (G), and blue (B). That is to say, the color representations in existing display devices are composed of the pixel groups including the four subpixels of R, G, B, and W. These display devices are hereinafter referred to as display devices of the RGBW scheme.

SUMMARY

The present inventors discovered the following problems in closely studying a display device of an RGBW scheme in which only a half number of the B-pixels are replaced by W-pixels (this scheme is hereinafter referred to as the pseudo-RGBW scheme) out of R-pixels, G-pixels, and B-pixels.

For example, if these pixels are changed in pitch (size), an optimal common voltage is likely to differ between the pixels of the different pitches according to particular differential changes in storage capacitance or parasitic capacitance due to manufacturing irregularities. Since the common voltage is applied to all pixels, the differences in optimal common voltage between the pixels of the different sizes need to be corrected with a voltage other than common voltage.

Other problems and new characteristics as well as features will be apparent from a detailed description of the present invention and the drawings accompanying the invention.

Some of typical aspects of the present invention will be described as the following.

A display device includes a first pixel group and a second pixel group, wherein a central value of positive-side and negative-side grayscale voltages for the first pixel group is set to be a fixed value, a common voltage is adjusted to an optimal value with respect to the first pixel group, and a difference between the common voltage adjusted to the optimal value with respect to the first pixel group and an optimal common voltage of the second pixel group is corrected by shifting entire positive-side and negative-side grayscale voltages of the second pixel group in a vertical direction.

In the above display device, the differences in optimal common voltage between the pixels of the different sizes can be corrected with a voltage other than common voltage.

BRIEF DESCRIPTION OF THE DRAWINGS

FIG. 9 shows data settings of grayscale voltage registers;

FIG. 10 shows data settings of grayscale voltage shifting registers;

DESCRIPTION OF THE PREFERRED EMBODIMENTS

Hereunder, an embodiment and examples of the present invention will be described with reference to the accompanying drawings. In the following description, the same reference number will be assigned to each of the same constituent elements and repeated description will be omitted.

The present inventors discovered the following problems in closely studying a display device of the pseudo-RGBW scheme.

In the display device of the pseudo-RGBW scheme, since only a half number of the B-pixels are replaced by W-pixels out of R-pixels, G-pixels, and B-pixels, color coordinates of white display by combination of RGB pixels need to be corrected by, for example, expanding an aperture area of the B-pixels relative to the R-pixels and the G-pixels (i.e., RG pixels). In addition, an aperture area of the W-pixels needs expansion since an increase in luminance, associated with the use of the W-pixels, will enhance effectiveness of W-pixel addition.

Realizing the above difference in aperture area without changing a pitch of the RGBW pixels involves reducing a black-matrix (BM) aperture ratio of the RG pixels relative to the B-pixels and the W-pixels (i.e., RG pixels), in which case the reduction in BM aperture ratio tends to become significant. It is therefore necessary to realize the difference in aperture area by increasing a pitch of the BW pixels relative to the RG pixels, not by reducing the BM aperture ratio relative to the BW pixels.

If these pixels are changed in pitch, an optimal common voltage is likely to differ between the RG pixels and the BW pixels according to particular differential changes in storage capacitance or parasitic capacitance due to manufacturing irregularities. Since the common voltage is applied to all pixels, a difference in optimal common voltage between the RG pixels and the BW pixels needs to be corrected with a voltage other than common voltage.

The above description will be explained in further detail below.

Figure 1A:
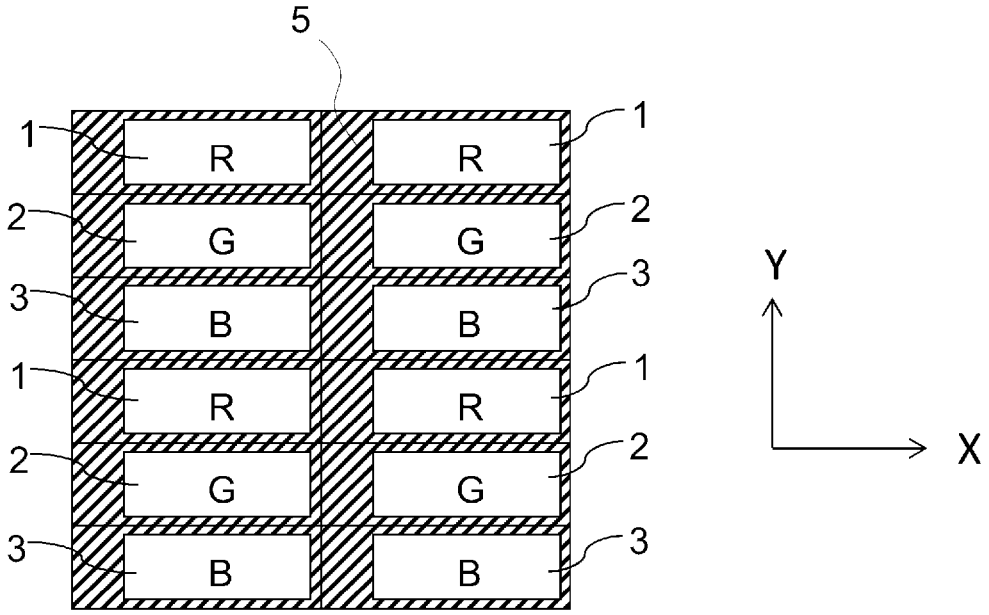
FIG. 1A shows a general array of RGB pixels.
Figure 1B:
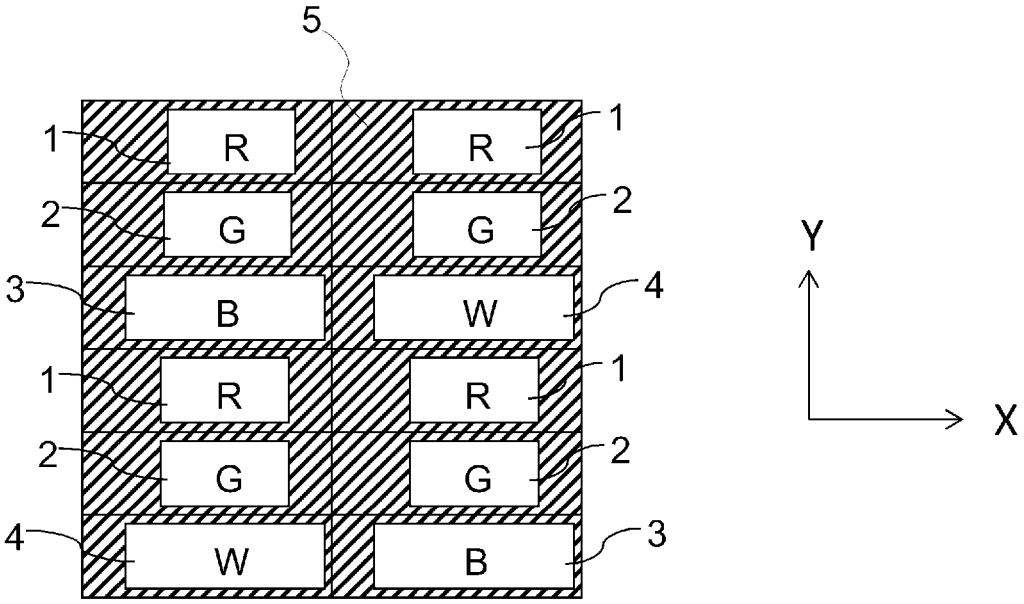
FIG. 1B shows an array of pixels (fixed in pixel pitch) in the pseudo-RGBW scheme.
Figure 1C:
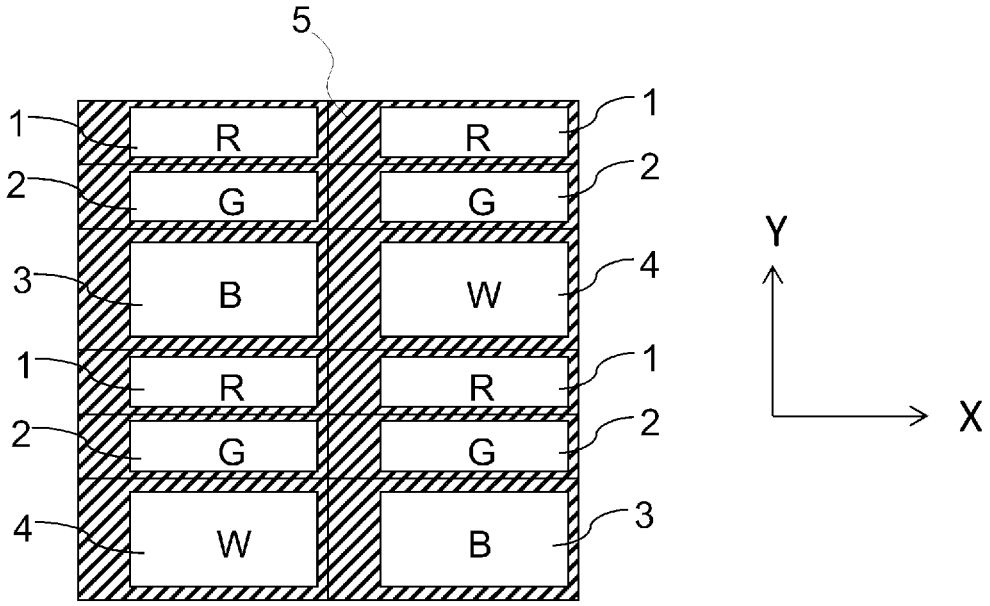
FIG. 1C shows an array of pixels (changed in pixel pitch) in the pseudo-RGBW scheme.

FIG. 1A shows a general array of RGB pixels. FIG. 1B shows an array of pixels (fixed in pixel pitch) in the pseudo-RGBW scheme. FIG. 1C shows an array of pixels (changed in pixel pitch) in the pseudo-RGBW scheme. Aperture ratios and pixel pitches of R-pixels 1, G-pixels 2, and B-pixels 3 are all the same in FIG. 1A.

In the RGBW scheme disclosed herein, ½ of the B-pixels 3 are replaced by the W-pixels 4, as shown in FIGS. 1B and 1C, to enhance transmittance through addition of the W-pixels. When the pixel array is viewed on a two-pixel basis, the number of sub-pixels in the B-pixels 3 is reduced to half that of the G-pixels 2 and the R-pixels 1, so the display of white by combination of the RGB pixels is likely to shift to yellow. To prevent this color shifting, there is a need to reduce the aperture ratios of the G-pixels 2 and the R-pixels 1 while increasing the aperture ratio of the B-pixels 3. Additionally, the aperture ratio of the W-pixels 4 is desirably maximized to make the addition of the W-pixels even more effective.

The above adjustment of the aperture ratios can be seen in FIG. 1B where an aperture ratio of BM5 in a color filter (CF) is adjusted. And the adjustment of the aperture ratios can be seen in FIG. 1C where the corresponding pixel pitches, that is, vertical (Y-axial) lengths of the pixels are changed. Horizontal (X-axial) length is not changed in FIG. 1C. It can be found that through comparison between FIGS. 1B and 1C, a reduction in the aperture ratio of BM5 in FIG. 1C is less significant and thus higher transmittance can be obtained.

Figure 2:
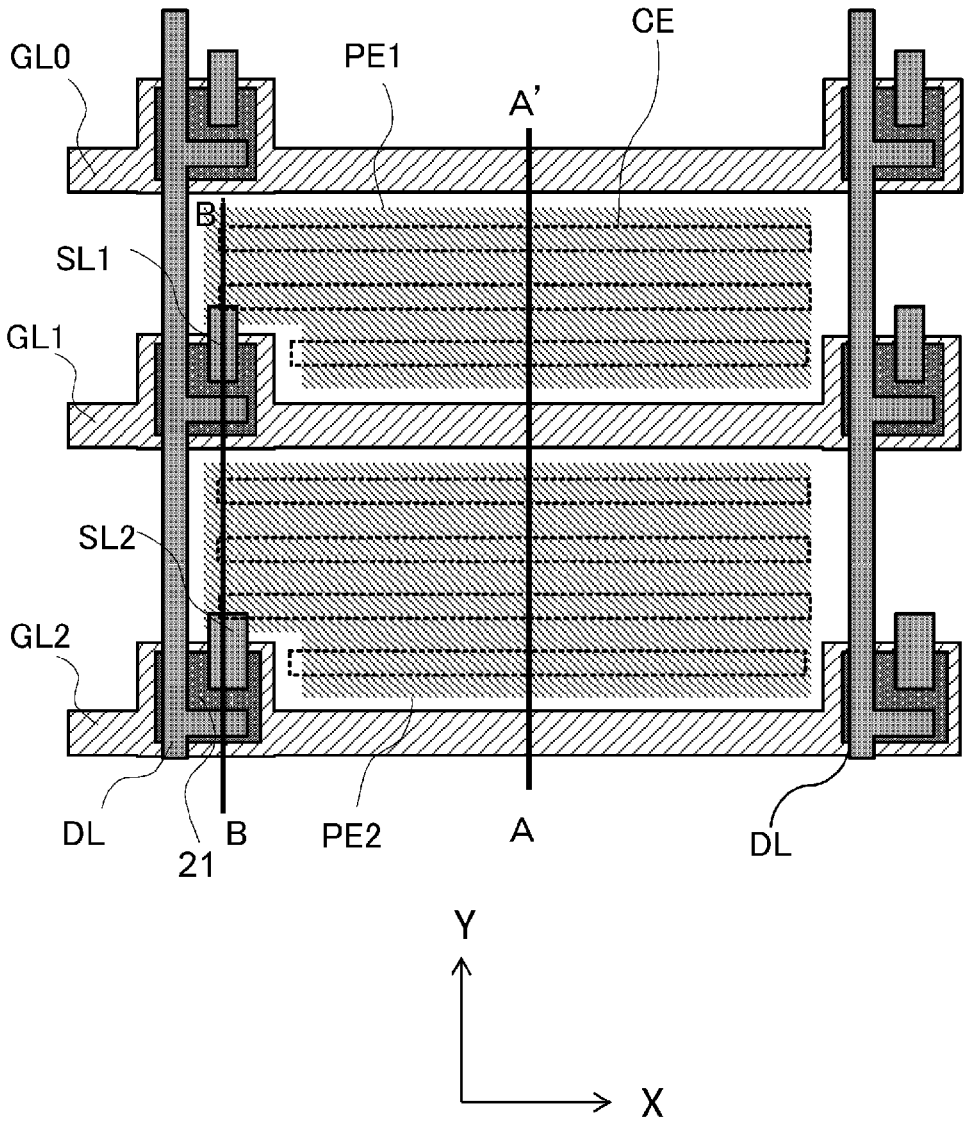
FIG. 2 is a pixel plan view showing another example of a pixel change in pixel pitch.
Figure 3A:
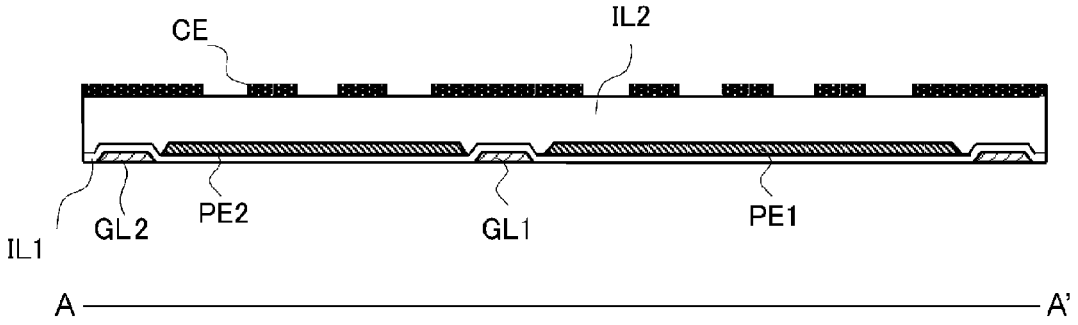
FIGS. 3A and 3B show a display region, FIG. 3A being a cross-sectional view of pixels taken along line A-A' of FIG. 2, FIG. 3B being a cross-sectional view of pixels taken along line B-B' of FIG. 2.
Figure 3B:
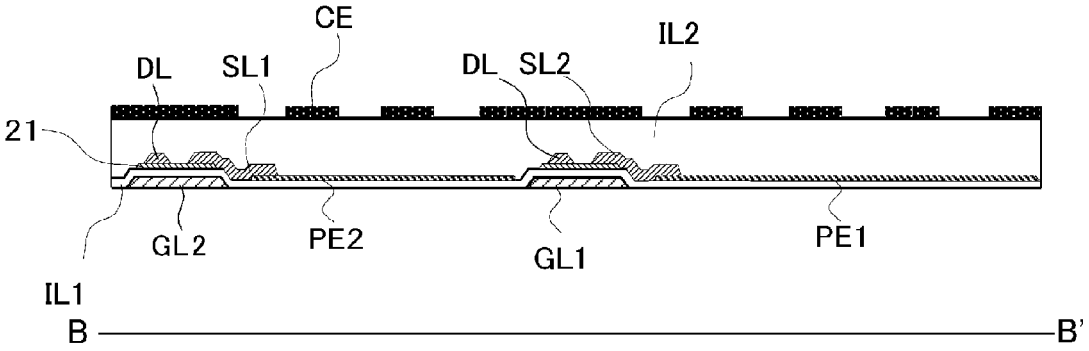

FIG. 2 is a pixel plan view showing another example of a pixel change in pixel pitch. FIG. 3A is a cross-sectional view of pixels taken along line A-A' of FIG. 2, and FIG. 3B is a cross-sectional view of pixels taken along line B-B' of FIG. 2. As shown in FIG. 2, Y-axial length of a pixel electrode PE2 is greater than that of a pixel electrode PE1, so that the pixel electrode PE2 has an area larger than that of the pixel electrode PE1. A striped common electrode CE above the pixel electrode PE2 has an area larger than that of a striped common electrode CE above the pixel electrode PE1. With reference to FIG. 2, a slit is formed inside a rectangle boxed with a dotted line, and a striped common electrode CE is absent in this rectangular section. A semiconductor layer 21 is formed above a gate line GL1 via an insulating layer ILL and above the semiconductor layer 21 are formed a drain line DL and a source line SL1, thus forming a thin-film transistor (TFT). The semiconductor layer here is formed from amorphous silicon (a-Si). The source line SL1 is connected to the pixel electrode PE1, above which a striped common electrode CE is formed via an insulating layer IL2. A source line SL2 is coupled to the pixel electrode PE2, above which a striped common electrode CE is formed via an insulating layer IL2. In the present invention, all pixels are in IPS (In-Plane Switching) mode and a storage capacitance of each pixel is formed by the pixel electrodes PE1, PE2 and the striped common electrodes CE, these two kinds of electrodes being respectively arranged below and above the insulating layers IL2.

Figure 4:
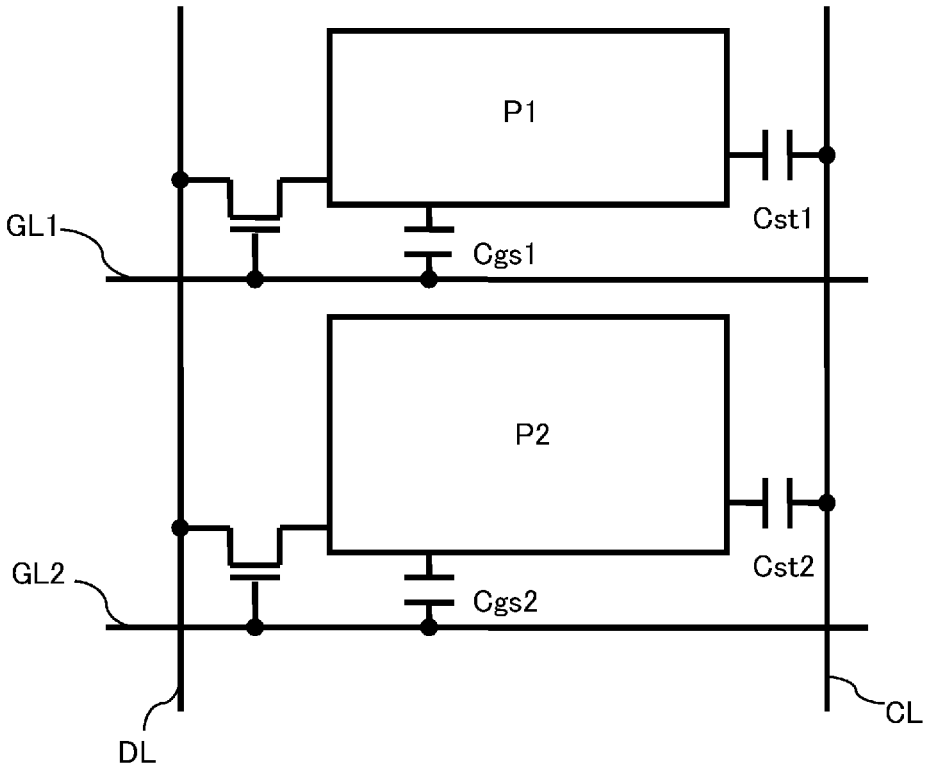
FIG. 4 shows an equivalent circuit of the pixels shown in FIG. 2.
Figure 5:
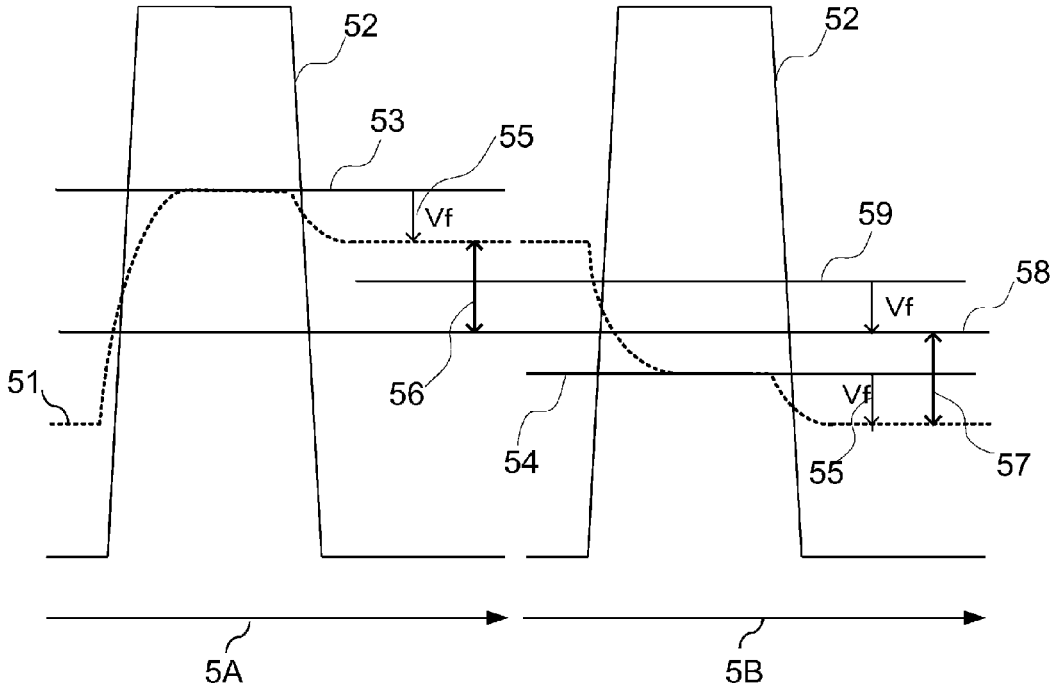
FIG. 5 is a schematic diagram of pixel driving.

FIG. 4 shows an equivalent circuit of the pixels shown in FIG. 2. A storage capacitance Cst1 constituted by the pixel electrode PE1 and the relevant striped common electrode CE is formed for a pixel P1. A storage capacitance Cst2 constituted by the pixel electrode PE2 and the relevant striped common electrode CE is formed for a pixel P2. A common line CL is connected to the striped common electrode CE. Because of a difference in pixel area, the storage capacitance Cst2 is greater than the storage capacitance Cst1. For the pixel P1, the pixel electrode PE1 and the gate line GL1 form a parasitic capacitance Cgs1, the pixel electrode PE1 being connected to the source line SL1. For the pixel P2, the pixel electrode PE2 and the gate line GL2 form a parasitic capacitance Cgs2, the pixel electrode PE2 being connected to the source line SL2. FIG. 5 is a schematic diagram of pixel driving. Pixel driving is described below taking columnar inversion driving as an example. A positive-electrode voltage is written in N-frame 5A, while a negative-electrode voltage is written in N+1 frame 5B. During a fall of a gate signal 52, a pixel electrode voltage denoted by a dotted line 51 in FIG. 5 experiences a voltage drop (Vf) 55 according to a particular parasitic capacitance, with respect to a positive grayscale voltage 53 and a negative grayscale voltage 54. In order to prevent a DC voltage from being applied to the pixel, therefore, a common voltage 58 is adjusted to a central value of a positive-electrode effective voltage 56 and negative-electrode effective voltage 57 after the above voltage drop. The common voltage 58 is adjusted to a value that is lower by Vf than a central value 59 of the grayscale voltages.

The voltage drop Vf during the fall of the gate signal 52 is calculated from a relation between a gate-to-source (gate line to pixel electrode) parasitic capacitance Cgs, a storage capacitance Cst, and amplitude (ΔV) of the gate signal. That is to say, Vf is calculated with the use of an expression of "Vf=Cgs/Cst*ΔV", which can be rewritten as "Vf1=Cgs1/Cst1*ΔV" in a case of the pixel P1 in FIG. 4, and as "Vf2=Cgs2/Cst2*ΔV" in a case of the pixel P2. To adjust the common voltage to the same value for both of the pixels P1 and P2, therefore, it is necessary to establish "Cgs1/Cst1=Cgs2/Cst2".

It is envisaged that thickness of the source lines for the pixels different in area as shown in FIG. 4 will be adjusted so that the ratio between the parasitic capacitance Cgs and the storage capacitance Cst will be the same between the pixels. However, in case of manufacturing irregularities relating to line widths of the striped common electrodes, thicknesses of the insulating layers, the matching of each layer, or others, changes in the parasitic capacitance Cgs and the storage capacitance Cst are estimated not to be the same. This is because each pixel has a different area and a different source line shape. If the changes are not the same, the difference in pixel shape will generate a difference in common voltage. The difference in common voltage due to the difference in pixel shape will lead to flickering, screen burn-in, or other unwanted events since the common voltage is applied in common to each pixel.

When the BW pixel pitch is enhanced compared to the RG pixel pitch in the pseudo-RGBW scheme, the TFT size needs to be larger to compensate for the lower mobility of amorphous silicon (a-Si) compared with the mobility of low-temperature polysilicon (LIPS). In addition, amorphous silicon (a-Si) generates a high parasitic capacitance, and significant changes in storage capacitance and parasitic capacitance arise from manufacturing irregularities. For these reasons, the optimal common voltage may differ between the RG pixels and the BW pixels. Since the same common voltage is applied to the RGBW pixels, if the optimal common voltage differs between the RG pixels and the BW pixels, the difference needs to be corrected with a voltage other than common voltage.

The central value of the grayscale voltages of the BW pixels is set to be a fixed value and the common voltage is adjusted to the optimal value with respect to the BW pixels. The difference from the optimal common voltage of the RG pixels is corrected by shifting an entire grayscale voltage of the RG pixels in a vertical direction. Alternatively, the central value of the grayscale voltages of the RG pixels is set to be a fixed value and the common voltage is adjusted to the optimal value with respect to the RG pixels. The difference from the optimal common voltage of the BW pixels is corrected by shifting an entire grayscale voltage of the BW pixels in a vertical direction.

Where a data range of positive-side and negative-side grayscale voltages which can be output from a driver IC is limited, shifting the entire grayscale voltage of a pixel in a vertical direction requires increasing an absolute value of a black voltage of the pixel whose grayscale voltage is to be shifted. When the absolute value of the black voltage is to be increased, since this increase may deteriorate contrast, the central value of the grayscale voltages of the BW pixels including the W-pixel highly susceptible to the deterioration of contrast is set to be a fixed value and the common voltage is adjusted to the optimal value with respect to the BW pixels. In addition, the difference from the optimal common voltage of the RG pixels is corrected with a voltage other than common voltage by shifting the entire grayscale voltage of the RG pixels in the vertical direction.

In the above manner, the common voltage upon both of the RG pixels and the BW pixels can be held and the difference in optimal common voltage between the RG pixels and the BW pixels can be corrected with a voltage other than common voltage.

In the above display device, when the pseudo-RGBW scheme is applied to a display panel that uses amorphous silicon (a-Si) in TFTs, the aperture ratio of the BW pixels can be significantly changed comparedly to the RG pixels, so that transmittance can be enhanced. The present embodiment may also be applied to a display panel that uses low-temperature polysilicon (LTPS) in TFTs.

The following examples of the present invention will each be described taking a display device of the pseudo-RGBW scheme as an example. The present invention, however, is not limited to these examples. It goes without saying that the invention can be applied to a display device in which a difference in pixel pitch or size, for example, causes a difference in optimal common voltage between a plurality of pixels to occur according to particular differential changes in storage capacitance and/or parasitic capacitance due to manufacturing irregularities.

First Example

Figure 6:
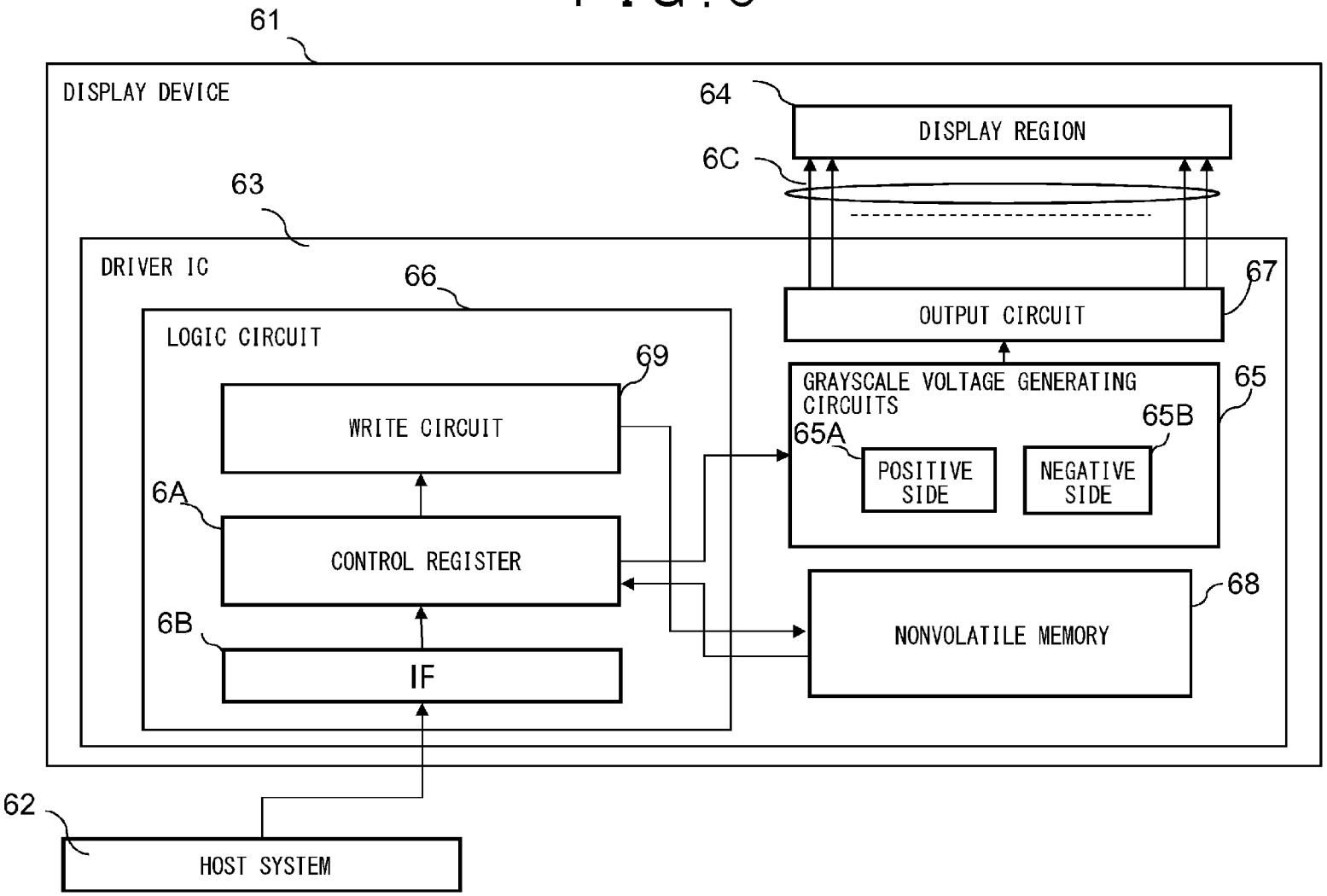
FIG. 6 is a block diagram of a display device according to a first example of the present invention.

FIG. 6 is a block diagram of a display device according to a first example of the present invention. The display device 61 of the pseudo-RGBW scheme includes a driver IC 63 and a display section 64. The display section 64 employs the pixel array shown in FIG. 1C, and the display section 64 is of a structure shown in at least one of FIGS. 2, 3A, and 3B.

Figure 13:
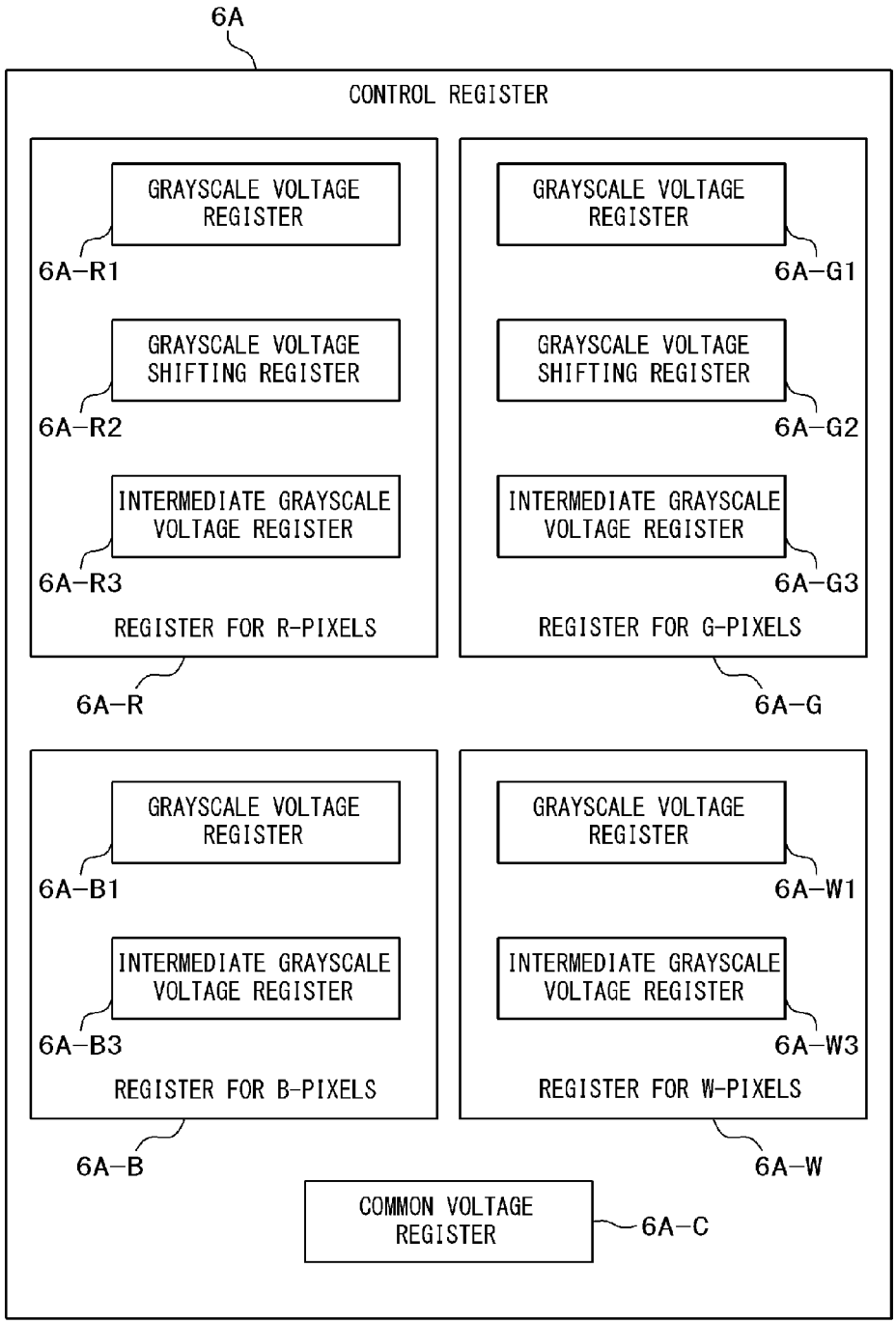
FIG. 13 shows a structure of a control register employed in the first example of the present invention.

The driver IC 63 includes a grayscale voltage generating circuit 65, a logic circuit 66, an output circuit 67, and a nonvolatile memory 68. The grayscale voltage generating circuit 65 includes a positive-side grayscale voltage generating circuit 65A and a negative-side grayscale voltage generating circuit 65B. The logic circuit 66 includes a writing circuit 69, a control register 6A, and an interface (IF) 6B. As shown in FIG. 13, the control register 6A includes a register 6A-R for R-pixels, a register 6A-G for G-pixels, a register 6A-B for B-pixels, a register 6A-W for W-pixels, and a common voltage register 6A-C. The register 6A-R for R-pixels includes a grayscale voltage register 6A-R1, a grayscale voltage shifting register 6A-R2, and an intermediate grayscale voltage register 6A-R3. The register 6A-G for G-pixels includes a grayscale voltage register 6A-G1, a grayscale voltage shifting register 6A-G2, and an intermediate grayscale voltage register 6A-G3. The register 6A-B for B-pixels includes a grayscale voltage register 6A-B1, a grayscale voltage shifting register 6A-B2, and an intermediate grayscale voltage register 6A-B3. The register 6A-W for W-pixels includes a grayscale voltage register 6A-W1, a grayscale voltage shifting register 6A-W2, and an intermediate grayscale voltage register 6A-W3. A host system 62 operates in such a manner that data and control signals are input to the driver IC 63 via the IF 6B. Data to be set in constituent elements of the control register 6A, namely the register 6A-R for R-pixels, register 6A-G for G-pixels, register 6A-B for B-pixels, register 6A-W for W-pixels, and common voltage register 6A-C, can also be assigned from an external element such as the host system 62. In the present example, however, data that has been stored in the nonvolatile memory 68 is written into the control register 6A. Grayscale voltage settings of the R-pixels, G-pixels, B-pixels, and W-pixels, or RGBW pixels in other words, are stored into the grayscale voltage registers 6A-R1, 6A-G1, 6A-B1, and 6A-W1, respectively. Data settings for shifting respective grayscale voltages of the RG-pixels are stored into the grayscale voltage shifting registers 6A-R2, 6A-G2. Respective intermediate grayscale voltage data settings of the RGBW pixels are stored into the intermediate grayscale voltage registers 6A-R3, 6A-G3, 6A-B3, 6A-W3. A common voltage data setting is stored into the common voltage register 6A-C. Grayscale voltages are generated by the positive-side grayscale voltage generating circuit 65A and the negative-side grayscale voltage generating circuit 65B. The output circuit 67 selects the generated grayscale voltages to be output to signal lines 6C.

Figure 7:
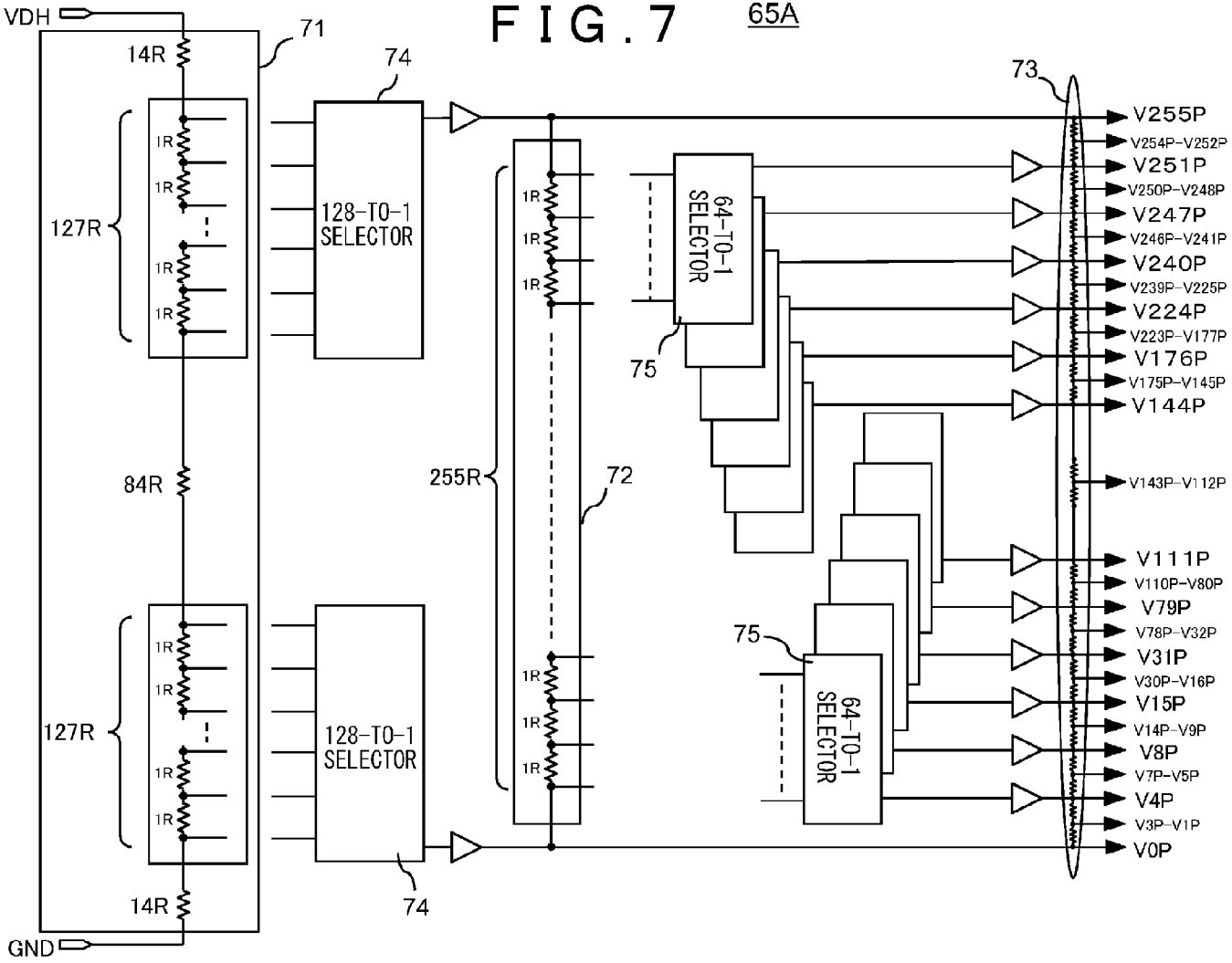
FIG. 7 is a schematic diagram of a positive-side grayscale voltage generating circuit having a function of shifting a grayscale voltage in the first example of the present invention.

FIG. 7 is a schematic diagram of the positive-side grayscale voltage generating circuit having a function of shifting a grayscale voltage in the first example of the present invention. The driver IC 63 includes one positive-side grayscale voltage generating circuit 65A, which generates the respective grayscale voltages of the RGBW pixels by means of time division processing. The positive-side grayscale voltage generating circuit 65A takes a high positive-side grayscale voltage as VDH and a low voltage as GND, and outputs a voltage obtained as a result of voltage division via a first resistor ladder 71. The positive-side grayscale voltage generating circuit 65A also outputs a voltage obtained by dividing a 255th grayscale voltage (V255P) on the positive side and a 0th grayscale voltage (V0P) on the positive side via a second resistor ladder 72. Through the grayscale voltage registers 6A-R1, 6A-G1, 6A-B1, 6A-W1, the grayscale voltages V255P and V0P are selected from the voltage that has been obtained by the voltage division via the first resistor ladder 71. Positive-side 251st, 247th, 240th, 224th, 176th, 144th, 111st, 79th, 31st, 15th, 8th, and 4th grayscale voltages are taken as V251P, V247P, V240P, V224P, V176P, V144P, V111P, V79P, V31P, V15P, V8P, and V4P, respectively. Through the intermediate grayscale voltage registers 6A-R3, 6A-G3, 6A-B3, 6A-W3, the 12 grayscale voltages are selected from the voltage that has been obtained from the voltage division via the second resistor ladder 72. With reference to all intermediate grayscale voltages except for the 14 grayscale voltages, 256 grayscale voltage signals are output that have been obtained from the voltage division via fixed resistors 73.

FIG. 9 shows data settings of the grayscale voltage registers. The grayscale voltage registers set grayscale voltages V255P, V0P, V255N, V0N, where V255N is a 255th grayscale voltage on the negative side and V0N is a 0th grayscale voltage on the negative side. As shown in FIG. 13, the driver IC 63 also includes four grayscale voltage registers for the respective RGBW pixels. The voltage settings of V255P, V0P, V255N, V0N can be stored into the grayscale voltage registers 6A-R1, 6A-G1, 6A-B1, 6A-W1. The voltages V255P, V0P, V255N, V0N each have six-bit grayscale voltage values. FIG. 10 shows data settings of grayscale voltage shifting registers. As shown in FIG. 13, the driver IC 63 further includes two grayscale voltage shifting registers: one for the R-pixels and the other for the G-pixels. The grayscale voltage shifting registers 6A-R2, 6A-G2 are common to V255P, V0P, V255N, V0N, and six-bit data settings from +32R to −31R are assigned to 6A-R2, 6A-G2. Finally the data settings of the grayscale voltage registers and those of the grayscale voltage shifting registers are added and then V255P, V0P, V255N, V0N are selectively output from a 128-to-1 (level) selector 74. On the basis of the intermediate grayscale voltage data settings of the intermediate grayscale voltage registers, the 12 voltages from V251P to V4P are selected from the second resistor ladder 72 by use of a 64-to-1 (level) selector 75. At this time, V255P and V0P each take any different value ranging from 1R/127R (inclusive) to 127R/127R (inclusive), and when a grayscale voltage is shifted, a value from +32R to −32R is added to the value immediately located to the left of the slash "/" in '/127R'. The value added, however, needs to be one ranging from 1R/127R (inclusive) to 127R/127R (inclusive).

Figure 8:
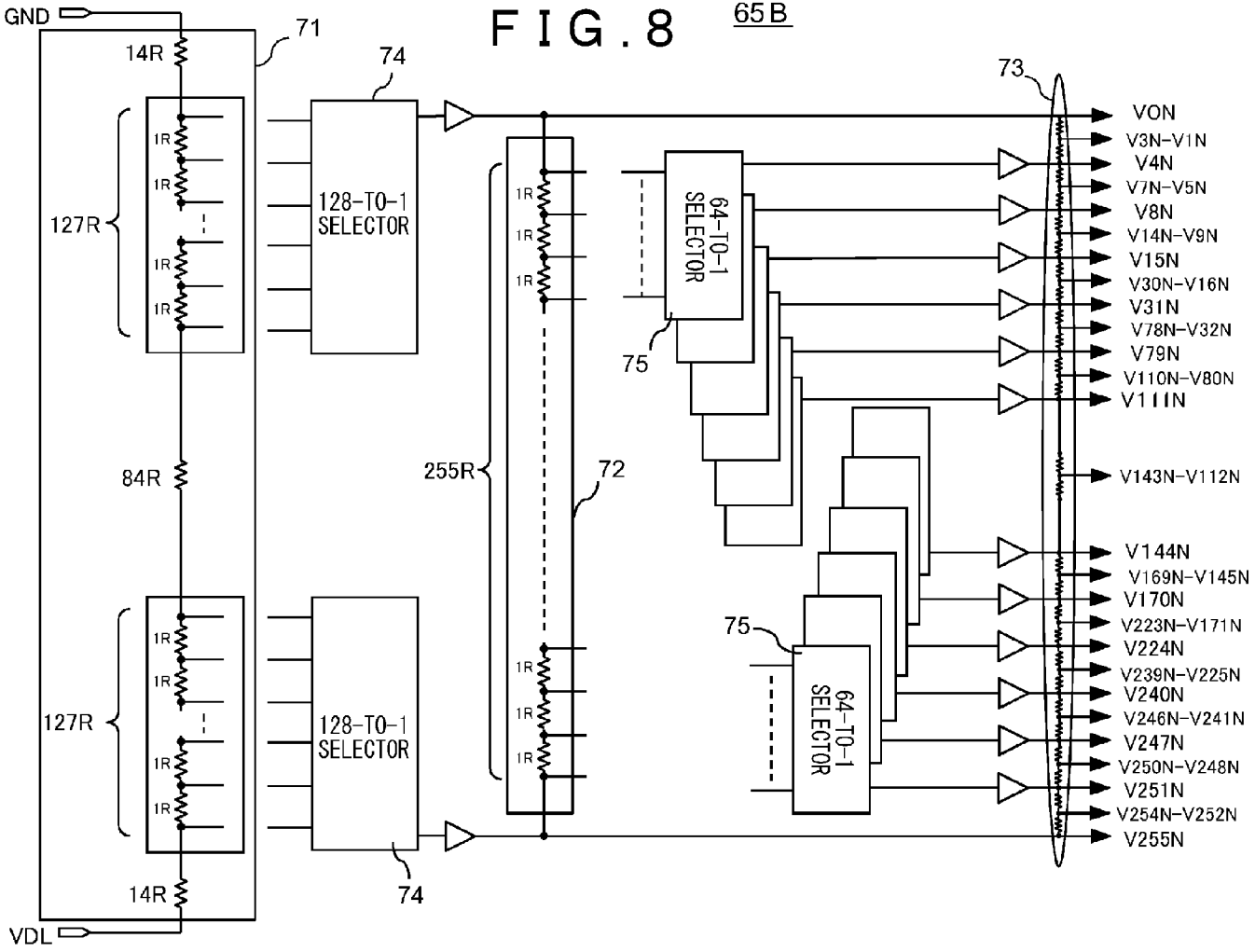
FIG. 8 is a schematic diagram of a negative-side grayscale voltage generating circuit having a function of shifting a grayscale voltage in the first example of the present invention.

FIG. 8 is a schematic diagram of the negative-side grayscale voltage generating circuit having a function of shifting a grayscale voltage in the first example of the present invention. The driver IC 63 further includes one negative-side grayscale voltage generating circuit 65B, which also generates the respective grayscale voltages of the RGBW pixels by means of time division processing. With reference to FIG. 8 here, VxN (x=0 to 255) denotes a negative-side xth grayscale voltage. The negative-side grayscale voltage generating circuit 65B takes circuit structure obtained by inverting that of the positive-side grayscale voltage generating circuit 65A. In the circuit structure of the negative-side grayscale voltage generating circuit 65B, since the grayscale voltage is shifted according to the same grayscale voltage shifting register value, the grayscale voltage is shifted in an opposite direction as shown in FIG. 10. For instance, if 79R/127R is selected for V255P, 79R/127R is selected for V255N, 20R/127R is selected for V0P, and 20R/127R is selected for V0N, when a 36th value of 23h (where "h" stands for hexadecimal) is set for the grayscale voltage shifting register, V255P becomes 76R/127R, V255N becomes 82R/127R, V0P becomes 17R/127R, and V0N becomes 23R/127R. As shown in FIG. 13, the control register 6A may be shared for both positive-side and negative-side grayscale voltage generating circuits. However, the register 6A-R for R-pixels, the register 6A-G for G-pixels, the register 6A-B for B-pixels, and the register 6A-W for W-pixels may be provided independently for each of the positive side and the negative side.

Figure 12:
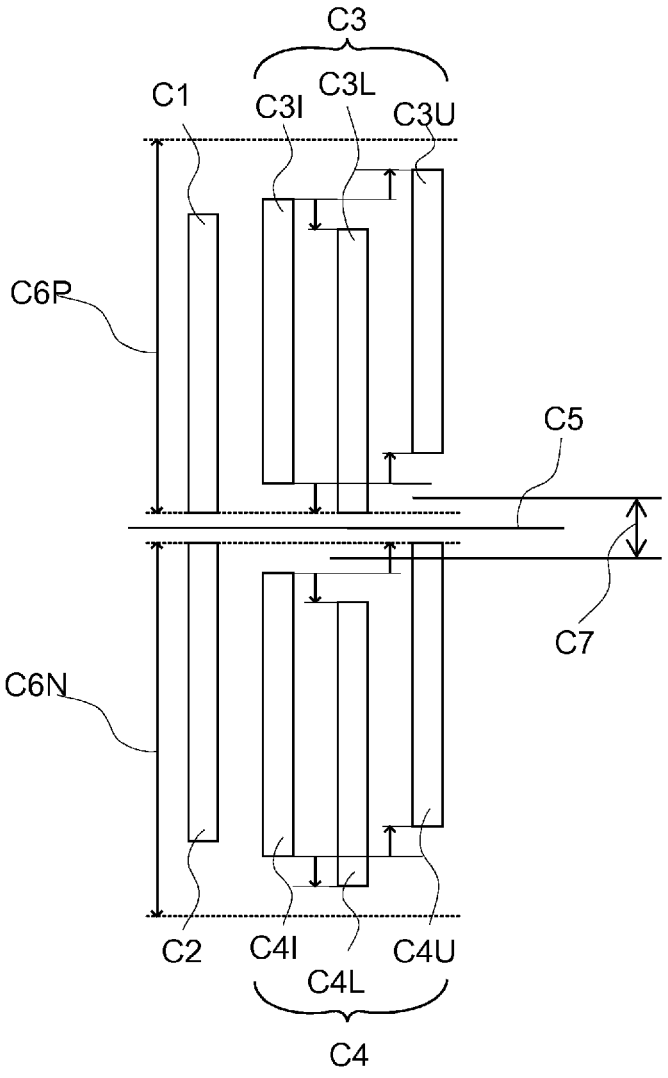
FIG. 12 is a schematic diagram showing how a grayscale voltage is shifted according to the first example of the present invention.

FIG. 12 is a schematic diagram showing how a grayscale voltage is shifted according to the first example of the present invention. The B-pixel positive-side grayscale voltage range C1 (V255P, V0P) and the B-pixel negative-side grayscale voltage range C2 (V255N, V0N) are fixed according to a particular grayscale voltage data setting of the grayscale voltage register 6A-B1. In accordance with a grayscale voltage shifting data setting of the grayscale voltage shifting register 6A-R2, the R-pixel positive-side grayscale voltage range C3 and the R-pixel negative-side grayscale voltage range C4 can be shifted in a vertical direction for a particular grayscale voltage data setting of the grayscale voltage register 6A-R1. This allows a central value of the R-pixel grayscale voltages to be changed from a central value C5 on the basis of the grayscale voltage data setting of the grayscale voltage register 6A-R1. This change, however, needs to be done within a range limited by a grayscale voltage range C6P or CPN. Reference number C31 in FIG. 12 denotes an initial value of the R-pixel positive-side grayscale voltage range, and a difference between a maximum value and minimum value of the initial value C31 is reduced by increasing the minimum value with respect to the B-pixel positive-side grayscale voltage range C1 according to the particular grayscale voltage data setting of the grayscale voltage register 6A-R1. The R-pixel positive-side grayscale voltage range C3 can be shifted in a range from a lower shifting limit C3L to an upper shifting limit C3U according to the particular grayscale voltage shifting data setting of the grayscale voltage shifting register 6A-R2. The R-pixel negative-side grayscale voltage range C4 can be shifted in a range from a lower shifting limit C4L to an upper shifting limit C4U according to the particular grayscale voltage shifting data setting of the grayscale voltage shifting register 6A-R2. In accordance with the data setting of the grayscale voltage shifting register 6A-R2, the central value of the R-pixel grayscale voltages is adjusted in a central-value adjustment range C7, with respect to the central value C5 based on a 33rd value of 20h in FIG. 10 that has been set in the R-pixel grayscale voltage register 6A-R1.

The G-pixel grayscale voltage, as with the R-pixel grayscale voltage, is fixed according to a particular grayscale voltage data setting of the grayscale voltage register 6A-G1. Next in accordance with a grayscale voltage shifting data setting of the grayscale voltage shifting register 6A-G2, the G-pixel grayscale voltage can be shifted in a vertical direction for a particular grayscale voltage data setting of the grayscale voltage register 6A-R1.

The W-pixel grayscale voltage, as with the B-pixel grayscale voltage, is a voltage for which a grayscale voltage shifting register is not allocated. For this reason, the W-pixel grayscale voltage is fixed according to a particular grayscale voltage data setting of the grayscale voltage register 6A-W1.

The RGBW-pixel grayscale voltage registers 6A-R1, 6A-G1, 6A-B1, 6A-W1 are each set to have an optimal value for a particular kind of product. The common voltage register 6A-C is set to have an optimal value for a particular product, the optimal value being geared to a value of the B-pixels and allowing for manufacturing irregularities. The common voltage that has been optimized for the BW pixels is set in the RG-pixel grayscale voltage shifting registers 6A-R2, 6A-G2. In these registers, therefore, a shifting value that allows for the manufacturing irregularities and becomes the optimal value for the particular product is set to absorb any differences due to the manufacturing irregularities. The data settings of the RG-pixel grayscale voltage shifting registers 6A-R2, 6A-G2 also are values that absorb any differences in Vf between the RG-pixels and the BW pixels.

In this way, the grayscale voltage data to be set in the grayscale voltage registers, and the grayscale voltage shifting data to be set in the grayscale voltage shifting registers are assigned, which allows the absorption of the differences in optimal grayscale voltage between different kinds of products, the manufacturing irregularities, and variations in Vf.

Although the present example has been described assuming that the RG-pixel grayscale voltage is shifted in the vertical direction with the BW-pixel grayscale voltage fixed, the BW-pixel grayscale voltage may be shifted in the vertical direction with the RG-pixel grayscale voltage fixed. In this case, whereas a grayscale voltage shifting register corresponding to the BW pixels will be disposed, one corresponding to the RG pixels will not be disposed.

Even so, the RG-pixel grayscale voltage is further desirably shifted in the vertical direction with the BW-pixel grayscale voltage fixed, because shifting the BW-pixel grayscale voltage in the vertical direction with the RG-pixel grayscale voltage fixed will keep the following advantages from being acquired. That is to say, where the data range of the positive-side and negative-side grayscale voltages which can be output from the driver IC is limited, shifting the entire grayscale voltage in the vertical direction requires to increase the absolute value of the black voltage of the pixel whose grayscale voltage is to be shifted. Since increasing the absolute value of the black voltage may deteriorate contrast, the central value of the grayscale voltages of the BW pixels including the W-pixel highly susceptible to the deterioration of contrast is set to be a fixed value based on the data setting of the grayscale voltage register. Additionally in accordance with the value that has been set in the common voltage register, the common voltage is adjusted to its optimal value with respect to the BW pixels. Furthermore, the difference from the optimal common voltage of the RG pixels is corrected with a voltage other than common voltage by shifting the entire grayscale voltage of the RG pixels in the vertical direction in accordance with the value that has been set in the common voltage shifting register.

In the present example, when the pseudo-RGBW scheme is applied to a display panel employing amorphous silicon (a-Si) in TFTs, the aperture ratio of the BW pixels can be significantly changed compared to the RG pixels, so that transmittance can be enhanced. The better transmittance enables the display device to have the same level of luminance as that of conventional products while only luminance of a backlight is lowered, thereby leading to a lower electric power consumption.

Second Example

Figure 11:
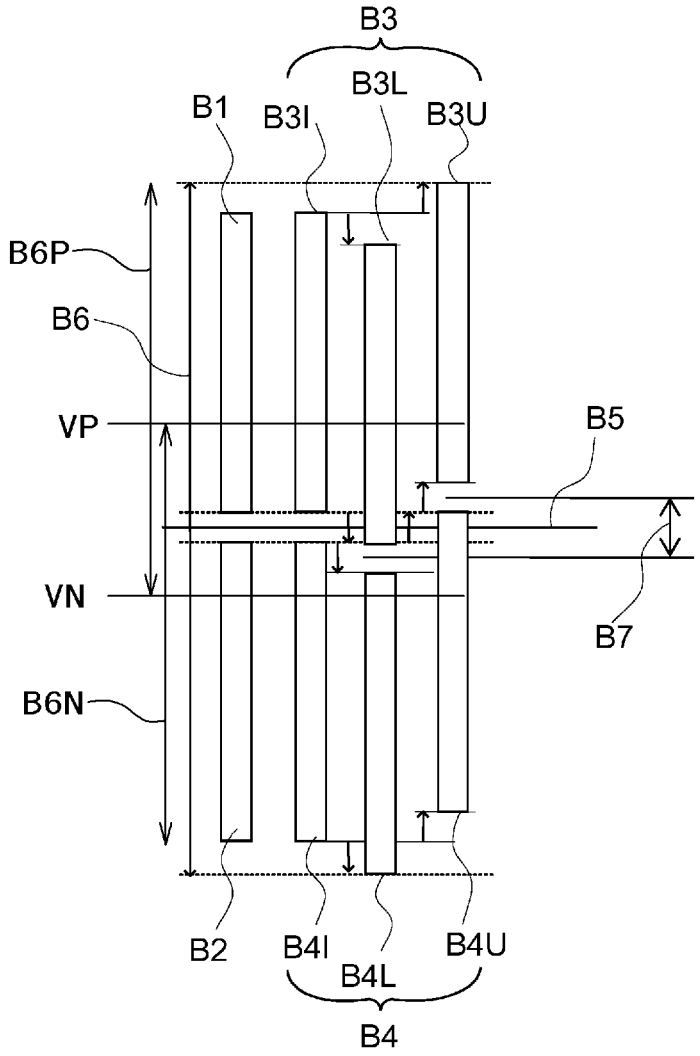
FIG. 11 is a schematic diagram showing how a grayscale voltage is shifted according to a second example of the present invention.

FIG. 11 is a schematic diagram showing how a grayscale voltage is shifted according to a second example of the present invention. The B-pixel positive-side grayscale voltage range B1 (V255P, V0P) and the B-pixel negative-side grayscale voltage range B2 (V255N, V0N) are fixed according to a particular grayscale voltage data setting of the grayscale voltage register 6A-B1. In accordance with a grayscale voltage shifting data setting of the grayscale voltage shifting register 6A-R2, the R-pixel positive-side grayscale voltage range B3 and the R-pixel negative-side grayscale voltage range B4 can be shifted in a vertical direction for a particular grayscale voltage data setting of the grayscale voltage register 6A-R1. This allows a central value of the R-pixel grayscale voltages to be changed from a central value B5 based on the R-pixel grayscale voltage data setting. This change, however, needs to be done within a range limited by the grayscale voltage output range. The R-pixel positive-side grayscale voltage range B3 has an initial value B31, which is the same as an initial value of the B-pixel positive-side grayscale voltage range B1. The R-pixel positive-side grayscale voltage range B3 can be shifted in a range from a lower shifting limit B3L to an upper shifting limit B3U according to the particular grayscale voltage shifting data setting of the grayscale voltage shifting register 6A-R2. The R-pixel negative-side grayscale voltage range B4 has an initial value B41, which is the same as an initial value of the B-pixel negative-side grayscale voltage range B2. The R-pixel negative-side grayscale voltage range B4 can be shifted in a range from a lower shifting limit B4L to an upper shifting limit B4U according to the particular grayscale voltage shifting data setting of the grayscale voltage shifting register 6A-R2. In the present example, since the data range B6P of the positive-side grayscale voltages which can be output overlaps the data range B6N of the negative-side grayscale voltages which can be output, the R-pixel grayscale voltage does not need to have its minimum value increased, in which respect the present example differs from the first example shown in FIG. 12. In accordance with the data setting of the grayscale voltage shifting register 6A-R2, the central value of the R-pixel grayscale voltages is adjusted with respect to the central value B5 based on the 33rd value of 20h in FIG. 10 that has been set in the R-pixel grayscale voltage register 6A-R1.

As in the first example, the G-pixel grayscale voltage, as with the R-pixel grayscale voltage, is fixed according to the particular grayscale voltage data setting of the grayscale voltage register 6A-G1. Next in accordance with the grayscale voltage shifting data setting of the grayscale voltage shifting register 6A-G2, the G-pixel grayscale voltage can be shifted in the vertical direction for the particular grayscale voltage data setting of the grayscale voltage register 6A-R1.

The W-pixel grayscale voltage, as with the B-pixel grayscale voltage, is a voltage for which a grayscale voltage shifting register is not allocated. For this reason, the W-pixel grayscale voltage is fixed according to the particular grayscale voltage data setting of the grayscale voltage register 6A-W1.

The RGBW-pixel grayscale voltage registers 6A-R1, 6A-G1, 6A-B1, 6A-W1 are each set to have an optimal value for a particular kind of product. The common voltage register 6A-C is set to have an optimal value for a particular product, the optimal value being geared to a value of the B-pixels and allowing for manufacturing irregularities. The common voltage that has been optimized for the BW pixels is set in the RG-pixel grayscale voltage shifting registers 6A-R2, 6A-G2. In these registers, therefore, a shifting value that allows for the manufacturing irregularities and becomes the optimal value for the particular product is set to absorb any differences due to the manufacturing irregularities. The data settings of the RG-pixel grayscale voltage shifting registers 6A-R2, 6A-G2 also are values that absorb any differences in Vf between the RG-pixels and the BW pixels.

In this way, the grayscale voltage data to be set in the grayscale voltage registers, and the grayscale voltage shifting data to be set in the grayscale voltage shifting registers are assigned, which allows the absorption of the differences in optimal grayscale voltage between different kinds of products, the manufacturing irregularities, and variations in Vf.

The display device according to the second example differs from that of the first example in terms of electric power supply circuit structure of the grayscale voltage generating circuit, and the data settings of the grayscale voltage registers and the grayscale voltage shifting registers.

More specifically the power supply circuit structure of the grayscale voltage generating circuit 65 differs in the following points. The GND voltage shown in FIG. 7 is lower than a GND voltage of VN in the positive-side grayscale voltage generating circuit 65A. The GND voltage shown in FIG. 8 is higher than a GND voltage of VP in the negative-side grayscale voltage generating circuit 65B. These differences enable overlapping between the data range B6P of the positive-side grayscale voltages which can be output, and the data range B6N of the negative-side grayscale voltages which can be output.

The present example has been described assuming that the RG-pixel grayscale voltage is shifted in the vertical direction with the BW-pixel grayscale voltage fixed. As in the first example, however, the BW-pixel grayscale voltage may be shifted in the vertical direction with the RG-pixel grayscale voltage fixed. Even in this case, as in the first example, the central value of the grayscale voltages of the BW pixels including the W-pixel highly susceptible to the deterioration of contrast is set to be a fixed value based on the data setting of the grayscale voltage register. Additionally in accordance with the value that has been set in the common voltage register, the common voltage is adjusted to its optimal value with respect to the BW pixels. Furthermore, the difference from the optimal common voltage of the RG pixels is preferably corrected with a voltage other than common voltage by shifting the entire grayscale voltage of the RG pixels in the vertical direction in accordance with the value set in the common voltage shifting register.

While the present invention has been described in detail above on the basis of its embodiment, examples, and modifications, the invention is not limited to the embodiment, the examples, and the modifications. It goes without saying that the invention may be changed and modified in various other forms.

What is claimed is:

1. A display device comprising:

a first pixel group including a white pixel and a blue pixel;

a second pixel group including a red pixel and a green pixel;

a first gate signal line connecting the first pixel group;

a second gate signal line connecting the red pixel of the second pixel group;

a third gate signal line connecting the green pixel of the second pixel group; and a grayscale voltage generating circuit including a resistor ladder and outputting a grayscale voltage to the first pixel group and the second pixel group, wherein:

the first pixel group has an electrode area size larger than that of the second pixel group;

a voltage drop adjusted central value of positive-side grayscale voltage and negative-side grayscale voltage for the first pixel group is set to be a common voltage which is a fixed value;

a voltage drop adjusted central value of positive-side grayscale voltage and negative-side grayscale voltage for the second pixel group is set to be an optimal common voltage of the second pixel group;

a difference between the common voltage and the optimal common voltage of the second pixel group is corrected by shifting entire positive-side and negative-side grayscale voltage of the second pixel group by increasing or reducing that of the second pixel group;

the grayscale voltage generating circuit output the grayscale voltage of the first pixel group according to the first gate signal line high voltage period, and the grayscale voltage of the second pixel group according to the second gate signal line high voltage period, and the grayscale voltage generating circuit generates the grayscale voltage of the second pixel group using the resistor ladder which configure to output a voltage shifted from the grayscale voltage of the first pixel group.

2. The display device according to claim 1, wherein the first pixel group has a plane area dimensionally different from a plane area of the second pixel group.

3. The display device according to claim 1, wherein the first pixel group has a plane area larger than a plane area of the second pixel group.

4. The display device according to claim 1, wherein the first pixel group is greater than the second pixel group in pitch.

5. The display device according to claim 1, wherein the first pixel group and the second pixel group each include a thin-film transistor of amorphous silicon.

6. The display device according to claim 1, wherein a total number of the blue pixel and white pixel in the first pixel group is half a total number of the red pixel and green pixel in the second pixel group.

7. The display device according to claim 1, further comprising:

a first and a second register, wherein:

the grayscale voltage generating circuit has the central value of the positive-side and the negative-side grayscale voltage for the first pixel group set to be a fixed value according to a particular data setting of the first register; and the grayscale voltage generating circuit has the entire positive-side and negative-side grayscale voltage of the second pixel group each shifted by increasing or reducing that of the second pixel group according to a particular data setting of the second register.

8. A display device of an RGBW scheme in which, out of red pixel, green pixel, and blue pixel, a half number of the blue pixel is replaced by white pixel, the device comprising:

the blue pixel and the white pixel greater than the red pixel and the green pixel in pitch;

a first gate signal line connecting the blue pixel and the white pixel;

a second gate signal line connecting the red pixel;

a third gate signal line connecting the green pixel; and a grayscale voltage generating circuit including a resistor ladder and outputting a grayscale voltage to the white pixel, the blue pixel, the red pixel, and the green pixel, wherein a voltage drop adjusted central value of positive-side and negative-side grayscale voltage of the blue pixel and the white pixel set to be a common voltage which is a fixed value;

a voltage drop adjusted central value of positive-side grayscale voltage and negative-side grayscale voltage for the red pixel and the green pixel is set to be an optimal common voltage of the red pixel and the green pixel; and a difference between optimal common voltage of the red pixel and the green pixel and the common voltage is corrected by shifting entire positive-side and negative-side grayscale voltage of the red pixel and the green pixel by increasing or reducing that of the red pixel and the green pixel;

the grayscale voltage generating circuit output the grayscale voltage of the white pixel and the blue pixel according to the first gate signal line high voltage period, and the grayscale voltage of the red pixel and the green pixel according to the second gate signal line high voltage period, the grayscale voltage generating circuit generates the grayscale voltage of the red pixel and the green pixel using the resistor ladder which configure to output a voltage shifted from the grayscale voltage of the red pixel and the green pixel.

9. The display device according to claim 8, further comprising:

a grayscale voltage register; and a grayscale voltage shifting register, wherein:

the grayscale voltage generating circuit has the central value of the positive-side and the negative-side grayscale voltage of the blue pixel and the white pixel set to be a fixed value according to a particular data setting of the grayscale voltage register; and the grayscale voltage generating circuit has the entire positive-side and negative-side grayscale voltage of the red pixel and the green pixel each shifted by increasing or reducing that of the red pixel and the green pixel according to a particular data setting of the grayscale voltage shifting register.

10. The display device according to claim 9, further comprising a nonvolatile memory, wherein the data setting of the grayscale voltage register and the data setting of the grayscale voltage shifting register are stored in the nonvolatile memory.

11. The display device according to claim 8, wherein the red pixel, the green pixel, the blue pixel, and the white pixel each include a thin-film transistor formed from amorphous silicon.

12. A display device comprising:

a display section having a plurality of pixels including a thin-film transistor formed from amorphous silicon;

a first gate signal line;

a second gate signal line;

a third gate signal line; and a driver IC including a grayscale voltage generating circuit, wherein:

the plurality of pixels are red pixel, green pixel, blue pixel, and white pixel;

a first gate signal line connecting the white pixel and the blue pixel;

a second gate signal line connecting the red pixel;

a third gate signal line connecting the green pixel;

a grayscale voltage generating circuit including a resistor ladder and outputting a grayscale voltage to the plurality of pixels;

the blue pixel and the white pixel are greater than the red pixel and the green pixel in pitch;

a common voltage is adjusted to an optimal value with respect to the blue pixel and the white pixel;

the grayscale voltage generating circuit has a central value of positive-side and negative-side grayscale voltage of the blue pixel and the white pixel set to be a fixed value;

the grayscale voltage generating circuit has a difference in optimal common voltage between the red pixel and the green pixel corrected by shifting entire positive-side and negative-side grayscale voltage of the red pixel and the green pixel by increasing or reducing that of the red pixel and the green pixel;

the grayscale voltage generating circuit output the grayscale voltage of the white pixel and the blue pixel according to the first gate signal line high voltage period, and the grayscale voltage of the red pixel and the green pixel according to the second gate signal line high voltage period, and the grayscale voltage generating circuit generates the grayscale voltage of the red pixel and the green pixel using the resistor ladder which configure to output voltage shifted from the grayscale voltage of the red pixel and the green pixel.

13. The display device according to claim 12, wherein:

the driver IC further includes a grayscale voltage register and a grayscale voltage shifting register; and the grayscale voltage generating circuit is composed so that:

the central value of the positive-side and the negative-side grayscale voltages of the blue pixel and the white pixel is set to be a fixed value according to a particular data setting of the grayscale voltage register; and the entire positive-side and negative-side grayscale voltage of the red pixel and the green pixel is each shifted by increasing or reducing that of the red pixel and the green pixel according to a particular data setting of the grayscale voltage shifting register.

14. The display device according to claim 13, wherein:

the driver IC further includes a nonvolatile memory; and the data setting of the grayscale voltage register and the data setting of the grayscale voltage shifting register are stored in the nonvolatile memory.

15. The display device according to claim 12, wherein:

the plurality of pixels have an arrangement sequence of the red pixel, the green pixel, the blue pixel, and the white pixel in a first direction; and the plurality of pixels have, in a second direction different from the first direction, the red pixel and the green pixel each arranged adjacently to a pixel of a same color, and the blue pixel and the white pixel alternately disposed.

* * * * *